US005899023A

United States Patent [19]

Byer

[11] Patent Number: 5,899,023

[45] Date of Patent: May 4, 1999

[54] HOLD DOWN CLAMPING MEANS FOR SCREENING MOUNTING ON RAIN GUTTERS

[76] Inventor: Joseph I. Byer, 36601 Howard Rd., Farmington Hills, Mich. 48331

[21] Appl. No.: 08/958,512

[22] Filed: Oct. 27, 1997

[51] Int. Cl.[6] ..... E04D 13/00

[52] U.S. Cl. ..... 52/12; 248/48.1

[58] Field of Search ..... 248/48.1, 48.2, 248/500; 52/12

[56] References Cited

U.S. PATENT DOCUMENTS

| | | | |
|---|---|---|---|
| 2,810,173 | 10/1957 | Bearden | 248/48.1 X |
| 3,023,544 | 3/1962 | Hughes | 52/12 |
| 3,297,285 | 1/1967 | Simmons | 248/48.1 |
| 4,351,134 | 9/1982 | Clarkson | 52/12 |
| 4,467,570 | 8/1984 | Kriegel | 52/12 |
| 4,888,920 | 12/1989 | Marulic | 52/12 |
| 5,040,750 | 8/1991 | Brant | 248/48.2 |
| 5,044,581 | 9/1991 | Dressler | 248/48.1 |
| 5,092,086 | 3/1992 | Rognsvoog, Sr. | 248/48.1 X |
| 5,321,920 | 6/1994 | Sichel | 52/12 |
| 5,398,464 | 3/1995 | Jacobs | 248/48.1 X |
| 5,566,513 | 10/1996 | Herren | 248/48.1 X |

*Primary Examiner*—Ramon O. Ramirez
*Attorney, Agent, or Firm*—Jerry G. Beck

[57] ABSTRACT

A hold down clamping means for screening or screen panels mounted on rain gutters attached to a facia board of a house comprising a clamping means and a hold down arm; the clamping means, when positioned over the outer wall of the rain gutter, locks the hold down clamping means to the gutter and positions the hold down arm into contact with the screening or screen panels to hold them securely in place.

5 Claims, 3 Drawing Sheets

HOLD DOWN CLAMPING MEANS FOR SCREENING MOUNTING ON RAIN GUTTERS

FIELD OF INVENTION

This invention relates to a simple hold down clamping means to permit the homeowner to hold in place conventional mesh screen panels which are mounted in the upper portion of rain gutters to keep leaves and other debris from clogging the gutters and connected down spouts. The hold-down means of this invention utilized to hold down the screening mounted on gutters can be installed speedily with relative safety by a layman such as the homeowner himself as no special tools are required.

BACKGROUND OF INVENTION

To prevent the accumulation of leaves and other debris from clogging the gutters attached to the facia board just below the sloping roof of houses, conventional pre-cut mesh screen panels made out of perforated sheet metal or molded plastic with drain openings can be purchased from hardware stores. These panels are then mounted in the upper portion of the gutters extending around the house. While cleaning the debris accumulated on top of these screen panels, some of these panels may become loose and fall to the ground or may have blown away during a bad storm. Cleaning gutters can be a hazardous activity as reaching or stretching is frequently necessary and special effort is required to install, remount or reposition the screen panels at times.

There are many devices are available on the market to keep gutters free of debris. There are permamently mounted screens directly attached to the gutters but they still require cleaning and are expensive to install and service as sheet metal specialists are needed. Specially hinged metal mesh panels have been developed as well as complex clamping systems but they present difficulty for their users to maintain these systems as they endanger themselves as some intricate work is frequently required while they are on top of ladders in order to be able to service these systems. To install these devices is very difficult as the fastening means and the fitting of the screening material require considerable effort, all which has to be done while standing precariously on a ladder.

DESCRIPTION OF RELATED PRIOR ART

It has been recognized that a problem exists in preventing gutters from getting clogged with leaves and other debris which can result in severe damage to the roofs and cause water leakage into the house itself. Prefabricated screening either cut to nominal lengths or rolls of screening materials are available for purchase by the homeowner from hardware or building material supply stores.

Providing hold down devices for these screening materials also has been addressed by the prior art. U.S. Pat. No. 4,467,570 depicts an especially designed stiff gutter guard provided with louvers and an inverted U-shaped retaining flange to hold the back of the guard in place against the rear wall of the gutter and a front locking snap clip which passes through the gutter guard under the flange or bead at the front wall of the gutter to hold the front edge of the gutter guard in place. Not only does this require a specially designed gutter guard but it would be difficult for a laymen to install it.

U.S. Pat. Nos. 4,351,134 and 5,321,920 describe gutter guards or screens which require mounting them underneath the shingles of the roof. The first mentioned patent depicts a hinged construction with the hinge straps secured to the roof itself and the second patent shows the rear portion of the gutter screen placed under the first row of the roof shingles and the front portion of the screen being attached by studs or rivets at the front of the gutter. This type of installation is difficult and time consuming.

U.S. Pat. No. 5,044,581 provides for a bendable support clip to which a screen can be attached. The support clip is U-shaped which extends the whole width of the gutter and is held by the gutter by wedging one end of the clip into the flange or bead of the front wall of the gutter and the other end of the clip between the rear wall of the gutter and the facia board. The clip is provided with spikes to which the wire meash material is attached. This clip is difficult to install for the homeowner as it has to be wedged in at both ends to provide a firm support for the screening material to be pushed onto the spikes. Attaching the screening to the clips is another difficult task which requires tools.

U.S. Pat. No. 4,888,920 requires unique angular molded mesh and retaining clips to hold in place on the gutter. The molded mesh has to have cut-outs to clear the sleeves of the gutter fastening devices which hold the gutter agaist the facia board of the house below the sloping roof. This technique requires cutting and fitting the mesh materials while in a precarious position.

The applicant has developed a low cost hold down clamping means for conventional gutter screen panels purchased ready made from hardware or building supply stores which will hold the panels in place when mounted in the upper portion of the rain gutter. The novel hold down clamping means of this invention is not only inexpensive but is also easy to install without requiring special tools or materials. Further, no changes to the building itself or to the gutter are required. It is simple to install as very little effort is required which reduces body movement while perched on a high ladder above the ground. A layman can do a professional installation so that expensive installers are not necessary which results in substantial savings to the homeowner.

DESCRIPTION OF THE PREFERRED EMBODIMENTS OF THIS INVENTION

Figure 1:
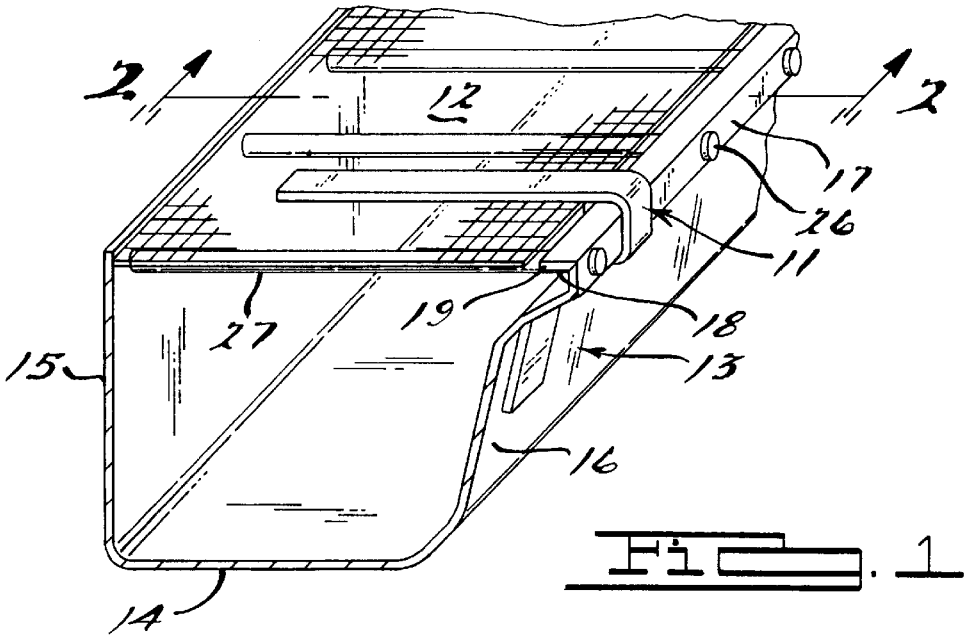
FIG. 1 is a perspective view of a portion of a roof gutter incorporating the hold down clamping means of this invention.
Figure 3:
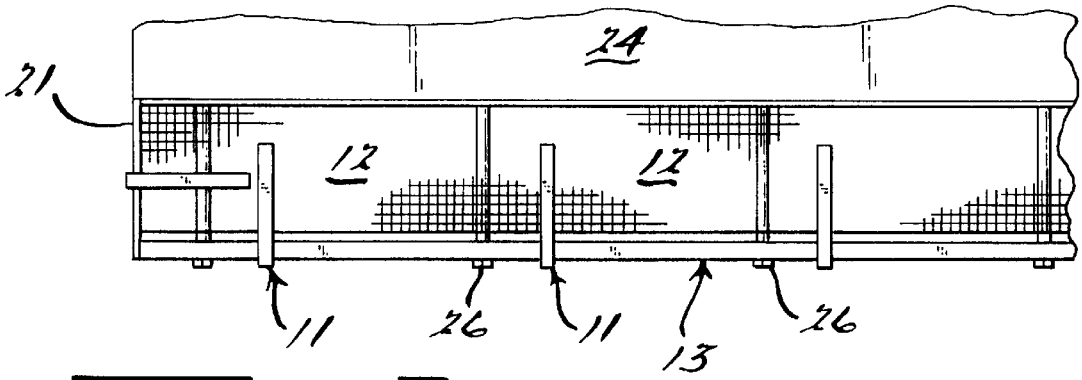
FIG. 3 is a partial top view of a portion of the gutter with the hold down clamping means of this invention in position.

FIG. 1 depicts a partial perspective view to illustrate how a hold down clamping means 11 of this invention to keep conventional perforated screen panels 12 in place when installed in the upper portion of a rain gutter 13. The hold down clamping means 11 of this invention basically consists of a clamping means attached to a gutter and a hold down arm for the screen panels 12 as detailed in the following specification. The conventional gutter 13 is "U" shaped having a base gutter section 14 extending horizontally with an inner gutter wall 15 extending upwardly at one end of the base gutter section 14 and an outer gutter wall 16 extending upwardly at the other end thereof. The inner gutter wall 15 is usually straight while the outer gutter wall 16 has a generally "P" shape terminating in a vertical section 17 provided with an inwardly extending flange 18, which, at times, has a bead 19 at the end thereof to eliminate any sharp edges. At each end of the gutter 13, end gutter walls 21 are provided, one of which is seen in partial top view in FIG. 3 to contain the rain water in the gutter 13 to assure that it flows to connected down spouts (not shown).

Figure 2:
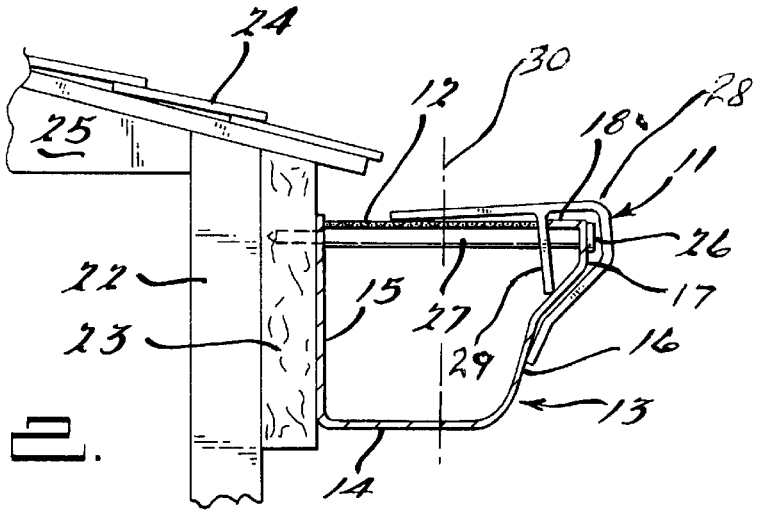
FIG. 2 is a sectional view along lines 2—2 of FIG. 1.

The gutter 13 is attached to a building structure 22 partially seen in part in FIG. 2. The building structure 22 incorporates a facia board 23 and a sloping roof 24 supported by a roof structure 25. The gutter 13 is positioned so that the outer face of the inner gutter wall 15 is flush with the facia board 23 just below the sloping roof 24 which overhangs the inner gutter wall 15 as depicted in FIG. 2. Gutter fasteners 26 such as long nails are driven through the vertical section 17 of the gutter 13 inwardly in a horizontal direction until they extend through the inner gutter wall 15 into the facia board 23. Sleeves 27 are inserted around the gutter fasteners 15 intermediate their ends before being driven through the inner gutter wall 15 into the facia board 23.

Figure 4:
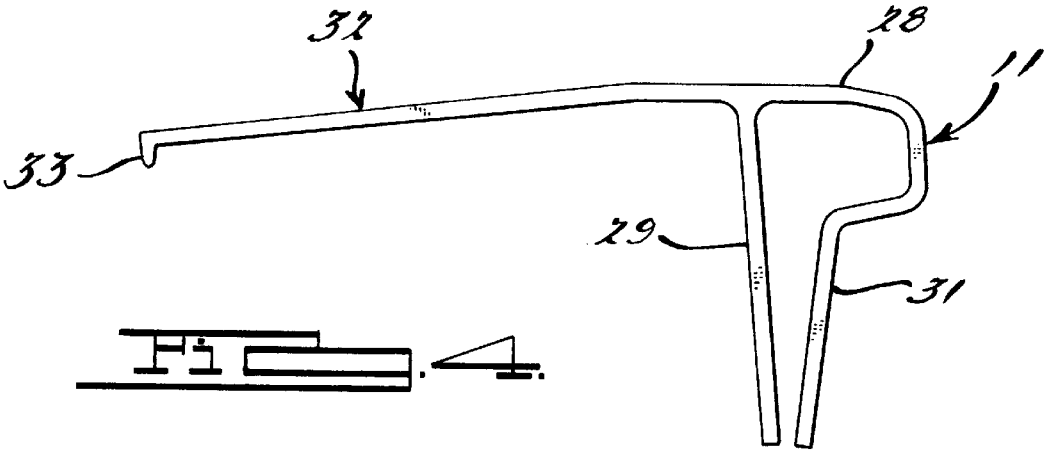
FIG. 4 is a side view of the hold down clamping means of a first embodiment of this invention.

The screen panels 12 are usually placed in the upper portion of the gutter 11 supported by the sleeves 27 or parts of the gutter 13 as seen in FIGS. 1 and 2, or the inner edge of the screen panels 12 may even lay over the outer edge of the sloping roof 24 if the gutter 13 is installed just below the overhang of the roof structure 25. To provide for ease of installation of the screen panels 12 and to prevent them from coming loose either while cleaning or due to strong winds, the novel hold down clamping means 11 of this invention has been developed. As best seen in FIG. 4, in a preferred embodiment of this invention, the hold down clamping means 11 is fabricated from a resilient spring like material having an partial inverted curved segment 28 with an inner clip leg 29 at one end and an outer clip leg 31 at the other end, both extending in a downward direction. The inner clip leg 29 is relatively vertical while outer clip leg 31 is curved and biased inwardly into frictional contact with the inner clip leg 29. From the top portion of the curved segment 28, a hold down arm 32 extends inwardly towards the inner gutter wall 15 in a slightly downward direction.

The hold down clamping means 11 is installed by spreading apart the ends of the clip legs 29 and 31 and then pushing the clip legs 29, 31 and the curved segment 28 in a downward direction so that the curved segment 28 encompasses the vertical section 17 and the flange 18 of the outer gutter wall 16 of the installed gutter 13 as best seen in FIG. 2. The downward extending inner clip leg 29 is biased by the resiliency of the material used in the fabrication of the hold down clamping means 11 into frictional contact with the inner surface of the outer gutter wall 16. The downward extending outer clip leg 31 is also biased by the its resiliency against the outer surface of the lower portion of the outer gutter wall 16, preferably in the lower portion of the "P" shaped outer gutter wall 16. The horizontal hold down arm 32 extends inwardly and downwardly towards the facia board 23 pushing down so that the end portion of the hold down arm 32 abuts the perforated screen panel 12 to hold it in place and keep it from lifting up. As best seen in FIG. 2, the arm 32 extends past the longitudinal center line 30 of the gutter 13 to provide sufficient leverage to assure that the screen panel 12 will stay in position when the curved segment 28 is pushed in place over the vertical section 17 and flange 18 of the outer gutter wall 16. Further, if desired, the hold down arm 32 of the hold down clamp means 11 can be provided with a slight downward hook 33 at the tip thereof to lock into one perforation of the screen panel 12 to prevent any movement of the screen panel 12. The alternate hook 33 is illustrated in FIG. 4.

Figure 5:
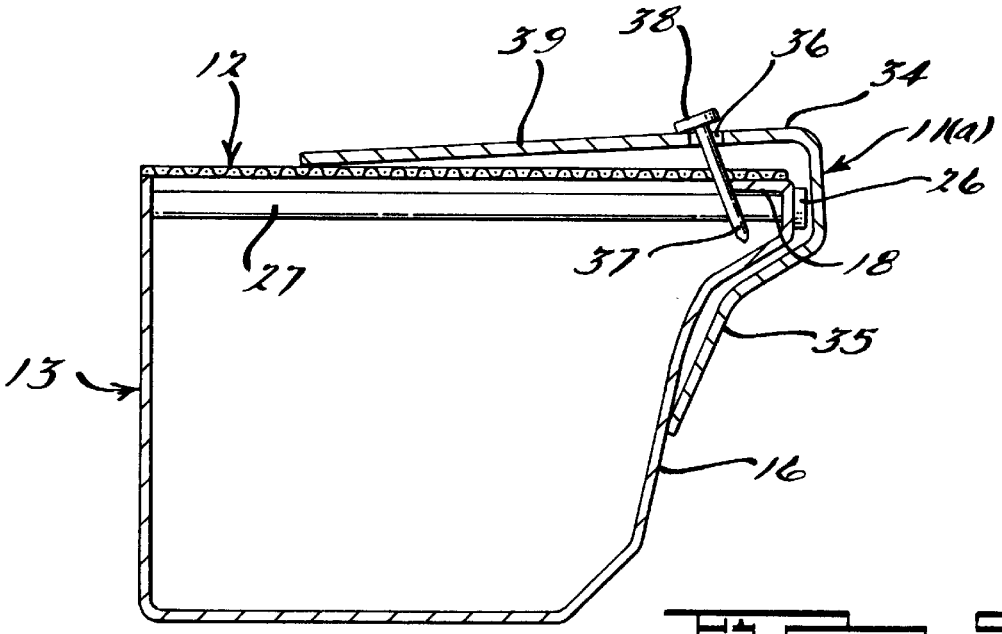
FIG. 5 is a side view of a hold down clamping means of a second embodiment of this invention mounted on a gutter shown partially in section.

In a second embodiment of this invention, the hold down clamping means 11 has an inner clip leg which is a separate piece and not integrally formed with the inverted curved segment 28. As seen in FIG. 5, in the second embodiment, a hold down clamping means 11(*a*) has a partial inverted curved segment 34 with an outer clip leg 35 at one end as in the previous embodiments. The other end of the curved segment 34 is provided with an aperture 36 through which a nail or dowel 37 is extended in a diagonally downward and outward direction towards the inner surface of the outer gutter wall 16. The nail or dowel 37 is provided with a head 38 which has a diameter larger than the diameter of the aperture 36. When the hold down clamping means 11 (*a*) is positioned over the outer gutter wall 16 and the nail 37 is pushed through the aperture 36 so that a portion of the nail or dowel 37 abuts the flange 18 and extends into the space below the flange 18 as seen in FIG. 5, the hold down clamping means 11(*a*) is locked into place and hold down arm 39 extending inwardly from the curved segment 34 secures the screen panel 12. As an alternative, the nail or dowel 37 could be replaced with a relatively thin, slightly flexible tab extending downward from the curved segment 34 to make frictional contact with the outer surface of flange 18 to lock the hold down clamping means 11(*a*) onto the gutter 13.

This embodiment is less expensive to manufacture and also provides for positive locking. Further, inexpensive conventional nails can be utilized. Any laymen can easily attach the hold down clamping means 11 (*a*) of this embodiment as only the nail 37 has to be pushed manually through the aperture 36 past the flange 18 to complete the installation.

Figure 6:
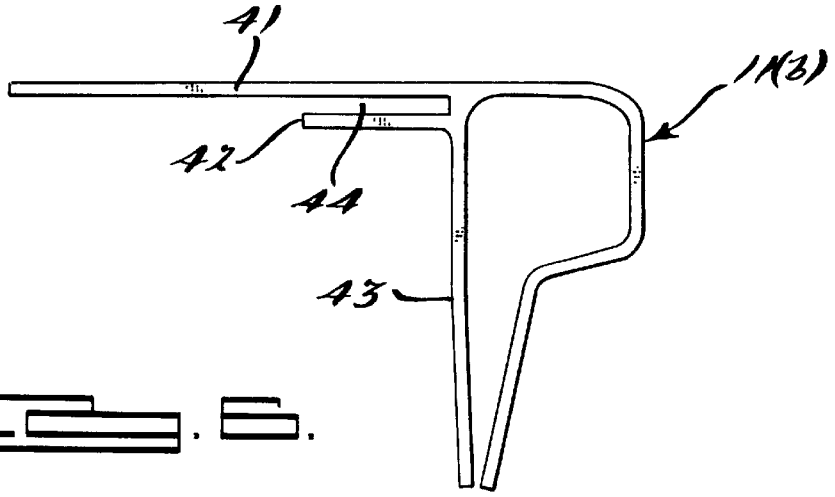
FIG. 6 is a side view of a third embodiment of the hold down clamping means of this invention.
Figure 7:
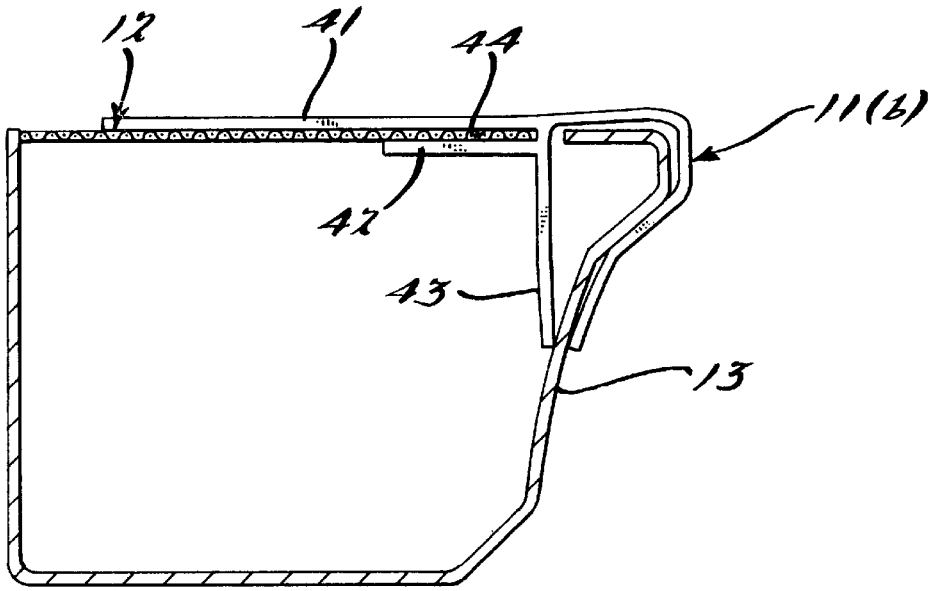
FIG. 7 is a partial perspective side view of the third embodiment of the hold down clamping means of this invention as shown in FIG. 6 installed on a gutter shown in section.

A further refinement of this invention is shown in FIG. 6 as a third embodiment. In this third embodiment, a hold down clamping means 11 (*b*) has been devised in which a hold down arm 38 is of a bifurcated construction. As best seen in FIGS. 6 and 7, the hold down arm 41 has a short arm segment 42 spaced from the underside of the hold down arm 41 close to the inner clip leg 43 and extending inwardly in a parallel relationship to the hold down arm 41 towards the inner gutter wall 15. An opening 44 is defined by the space between the underside of the hold down arm 41 and the upper upper surface of the short arm segment 42. The outer edge of screen panel 12 is received in the opening 44 to hold the screen panel 12 firmly in place whenever the hold down clamping means 11 (*b*) is mounted on outer gutter wall 16. The bifurcated construction requires less leverage for the hold down arm 41 than the hold down arms in the embodiments of this invention previously described.

Figure 8:
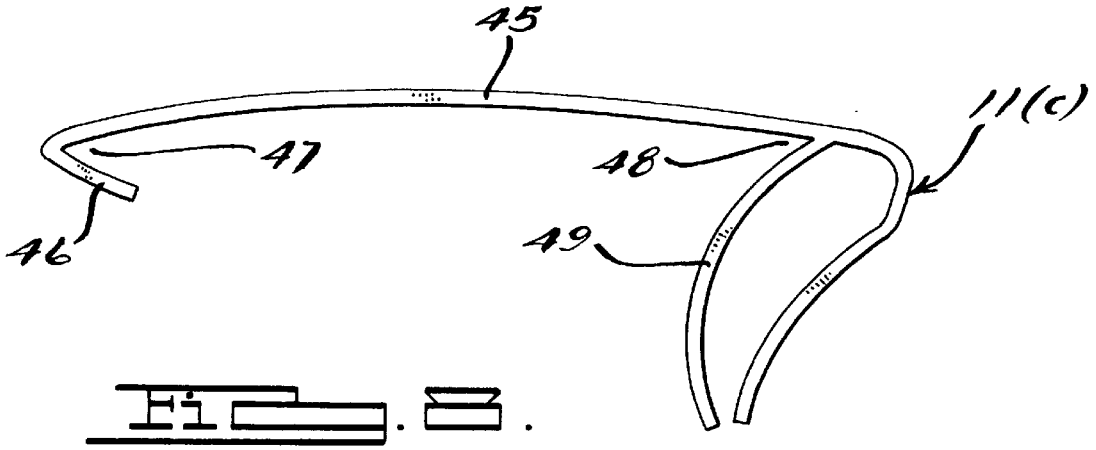
FIG. 8 is a side view of a fourth embodiment of the hold down clamping means of this invention.

In a further refinement of the third embodiments a hold down clamping means 11 (*c*) has been developed as shown in FIG. 8 in which a curved hold down arm 45 that extends the whole width of the gutter 13 is provided with structure at each end thereof to receive the inner and outer edges of the screen panel 12. A spaced short arm segment 46 or just a hooked end is provided at the underside of the hold down arm 45 at its far end near the inner gutter wall 15 to define a first opening 47 that receives the inner edge of the screen panel 12. A second opening 48 can be achieved by either utilizing a bifurcated construction as seen in FIGS. 6 and 7 or by shaping the upper portion of the inner clip leg 49 to form a recess on the underside of the hold down arm 43 near the inner clip leg 49 to receive the outer edge of the screen panel 12. In the utilization of this fourth embodiment, the screen panel 12 can be pre-cut and fitted to the hold down clamping means 11 (*c*) prior to installation on the gutter 13 and assume the shape of the curvature of the hold down arm 45. It is also possible to have the bifurcated construction incorporated on the upper surface of the curved hold down arm 45 so that the screen panel 12 can be serviced from above the gutter 13 without removing or demounting the hold down clamping means 11 (*c*).

Figure 9:
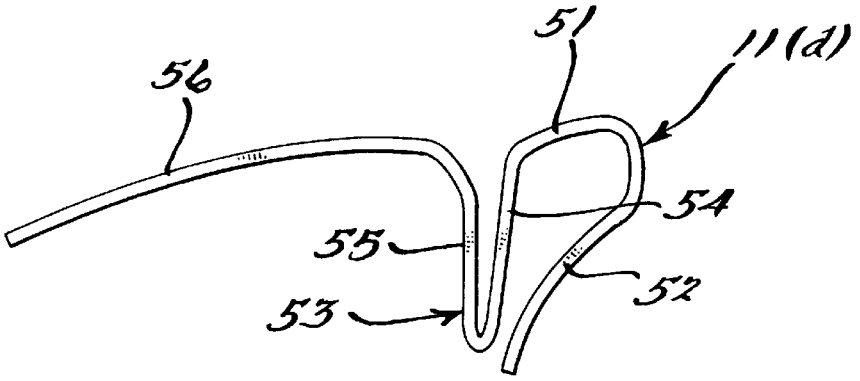
FIG. 9 is a side view of a fifth embodiment of the hold down clamping means of this invention.

The hold down clamping means 11 can be molded from a resilient plastic material which is weather resistant but this could be quite expensive to form. In the fifth embodiment of this invention as seen in FIG. 9, a hold down clamping means 11 (*d*) is illustrated that could be fabricated from a one-piece, rust resistant, medium-gauge spring wire bent to the shape required to provide the functions already described. A typical configuration is seen in FIG. 9. In this embodimeny of the hold down clamping means 11 (*d*) as seen in FIG. 9, an inverted curved segment 51 is continuously formed having at one end an outer clip leg 52 and at the other end an inner clip leg 53. The inner clip leg leg 53 consists of a downward clip leg segment 54 extending in a vertical downward direction and then looping back in a very tight loop to form a vertical upward inner clip leg segment substantially parallel to the downward inner clip leg segment 54 before continueing to form hold down arm 56. The outer and inner clip legs 52, 53; the hold down arm 56; and curved segment 51 are very similar in shape and function as in the embodiments of this invention previously described except that they are formed from a continuous spring wire. The spring wire has sufficient resiliency to easily form and hold the desired shape and to provide the resiliency required for ther clamping and hold down functions of the hold down clamping means 11 (*d*) of this invention. Such spring wire construction is relatively inexpensive and provides the same benefits as the other embodiments heretofore discussed.

It is to be understood from the description of the various embodiments of this invention that an effective, inexpensive hold down clamping means for conventional perforated screen panels for rain gutters has been achieved which will allow any layman home owner to easily install and clean gutter screening less hazardly and at a very low cost. Further, it will prevent the screening material from being blown away by the wind under adverse weather conditions.

While only the preferred embodiments of the present invention have been described, others may be possible without departing from the scope of the appended claims.

I claim:

1. A hold down clamping means to be used in combination with a perforated screen panel mounted in the upper portion of a rain collecting gutter, said gutter attached to a facia board of a building structure below the roof line of said building structure, said gutter having a generally "U" shaped cross section comprising a horizontally extending base section, an inner gutter wall extending vertically upwardly from one end of said base section and in juxtaposition with said facia board, and an outer gutter wall extending generally upwardly from the other end of said base section, said outer gutter wall terminating in a horizontally, inwardly extending flange, comprising (a) a partial inverted segment, (b) a resiliently biased inner clip leg extending generally downwardly from one end of said curved segment, (c) a resiliently biased outer clip leg extending generally downwardly from the other end of said curved segment towards the inside surface of said outer gutter wall, and (d) a resilent hold down arm extending from the upper portion of said curved segment the whole width of said gutter towards said facia board, said hold down arm having a bifurcated structure to define a first opening at one end thereof, a second opening being provided at the other end of said hold down arm at the juncture of said hold down arm and said inner clip leg with inner and outer edges of said screen panel being received in said first opening and second opening of said hold down arm, said hold down clamping means, when positioned over said outer gutter wall so that said curved segment encompasses said flange, said outer clip leg making frictional contact with the outside surface of said outer gutter wall, and said inner clip leg making frictional contact with the inside surface of said outer gutter wall to lock said hold down clamping means in place with said hold down arm securely positioning said screen panel in the upper portion of said gutter.

2. A hold down clamping means to be used in combination with a perforated screen panel mounted in the upper portion of a rain collecting gutter, said gutter attached to a facia board of a building structure below the roof line of said building structure, said gutter having a generally "U" shaped cross section comprising a horizontally extending base section, an inner gutter wall extending vertically upwardly from one end of said base section and in juxtaposition with said facia board, and an outer gutter wall extending generally upwardly from the other end of said base section, said outer gutter wall terminating in a horizontally, inwardly extending flange, comprising (a) a partial inverted curved segment, (b) a resiliently biased inner clip leg extending generally downwardly from one end of said curved segment towards the inside surface of said outer gutter wall, (c) a resiliently biased outer clip leg extending generally downwardly from the other end of said curved segment towards the outside surface of said outer gutter wall, and (d) a resilient hold down arm extending inwardly in a generally horizontal direction from the upper portion of said inner clip leg and being of a length greater than half the width of said gutter, said curved segment, said inner clip leg, said outer clip leg, and said hold down arm being integrally formed from a continous resilient spring wire with said inner clip leg extending from said curved segment having a vertically downward segment and a vertically upward segment before continuing to form said hold down arm, said downward segment and said upward segment of said inner clip leg being connected by a loop at one end thereof and being substantially parallel to and contiguous with each other, said hold down clamping means, when positioned over said outer gutter wall so that the curved segment encompasses said flange, said outer clip leg making frictional contact with the outside surface of said outer gutter wall, said said inner clip leg making frictional contact with the inside surface of said outer gutter wall, to lock said hold down clamping means in place with said hold down arm abutting the upper surface of said screen panel to hold said screen panel securely on said gutter.

3. The hold down clamping means of claim 2 in which said spring wire is of a non-rusting material.

4. A hold down clamping means to be used in combination with a perforated screen panel mounted in the upper portion of a rain collecting gutter, said gutter attached to a facia board of a building structure below the roof line of said building structure, said gutter having a generally "U" shaped cross section comprising a horizontally extending base section, an inner gutter wall extending vertically upwardly from one end of said base section and in juxtoposition with said facia board, and an outer gutter wall extending generally upwardly from the other end of said base section, said outer gutter wall terminating in a horizontally, inwardly extending flange, comprising (a) a partial inverted curved segment (b) a dowel extending generally diagonally in a downward and outward direction from the other end of said curved segment inward of said one end, (c) a resiliently biased outer clip leg extending generally downwardly from one end of said curved segment towards the outside surface of said outer gutter wall, and (d) a resilient hold down arm extending in a horizontally inward direction from the one end of said curved segment and being of a length greater than half the width of said gutter, said hold down clamping means, when positioned over said outer gutter wall so that the curved segment encompasses said flange, said outer clip leg making frictional contact with the outside surface of said outer gutter wall, said dowel making contact with the inside surface of said outer gutter wall to lock said hold down clamping means in place with said hold down arm abutting the upper surface of said screen panel to hold said screen panel securely on said gutter.

5. The hold down clamping means of claim 3 wherein said curved segment is provided with an aperture at the other end thereof, said dowel extending through said aperture in a downward direction towards the inner surface of said outer gutter wall.

* * * * *